US007778563B2

(12) United States Patent
Eun et al.

(10) Patent No.: US 7,778,563 B2
(45) Date of Patent: Aug. 17, 2010

(54) VARIABLE SPEED FUSING

(75) Inventors: Yongsoon Eun, Webster, NY (US); Eric Scott Hamby, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 163 days.

(21) Appl. No.: 12/099,262

(22) Filed: Apr. 8, 2008

(65) Prior Publication Data

US 2009/0252518 A1 Oct. 8, 2009

(51) Int. Cl.
*G03G 15/20* (2006.01)
*G03G 15/00* (2006.01)

(52) U.S. Cl. ..... 399/68; 399/43; 399/45

(58) Field of Classification Search ..... 399/68, 399/67, 69, 43, 45, 337
See application file for complete search history.

(56) References Cited

U.S. PATENT DOCUMENTS 4,319,874 A 3/1982 Sawano
6,381,422 B1 4/2002 Tanaka
6,816,686 B2 * 11/2004 Hooper et al. ..... 399/44
6,982,781 B2 1/2006 Vetromile et al.
2006/0013602 A1 1/2006 Lee et al.
2006/0216048 A1 * 9/2006 Fujii et al. ..... 399/45

OTHER PUBLICATIONS

European Search Report, Mailed Jul. 20, 2009.

* cited by examiner

*Primary Examiner*—David M Gray
*Assistant Examiner*—Rodney Bonnette
(74) *Attorney, Agent, or Firm*—Fay Sharpe LLP

(57) ABSTRACT

Systems and methods are described that facilitate reducing temperature droop during an initial portion of a print job by reducing fuser speed to increase fuser-to-paper interaction while fuser heat is absorbed by the paper during a temperature transient. For instance, during a first N pages of a print job, where N is an integer, the paper acts as a heat sink and exerts a thermal load on the fuser roll. To compensate, fuser speed is reduced initially to ensure that a given amount of heat is applied to toner on the pages. Fuser speed is increased until fuser temperature reaches steady state. Acceleration of the fuser is also adjustable.

20 Claims, 3 Drawing Sheets

VARIABLE SPEED FUSING

BACKGROUND

The subject application relates to document printing, and more particularly to adjusting the speed and/or acceleration of a fuser drive during a print job to mitigate temperature droop during fuser operation.

In typical electrophotographic image forming devices, such as copy machines and laser beam printers, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a marking material. Generally, the marking material comprises pigmented toner particles adhering triboelectrically to carrier granules, which is often referred to simply as toner. The developed image is subsequently transferred to the print medium, such as a sheet of paper. The fusing of the toner image onto paper is generally accomplished by applying heat and pressure. A typical fuser apparatus includes a fuser roll and a pressure roll which define a nip therebetween. The side of the paper having the toner image typically faces the fuser roll, which is often supplied with a heat source, such as a resistance heater, at the core thereof. The combination of heat from the fuser roll and pressure between the fuser roll and the pressure roll fuses the toner image to the paper, and once the fused toner cools, the image is permanently fixed to the paper.

Conventional fusers suffer from initial temperature transients (droop) at the beginning of a job. This results in gloss and color variation within a job. For example, a number of sheets, typically a first and second sheet or so, come out with higher gloss, while a subsequent several sheets (e.g., $3^{rd}$ to $50^{th}$ sheets or so) exhibit reduced gloss relative to sheets thereafter due to the temperature transients. This problem is more pronounced in entry production and production market segments, where multiple copies of same set of images are printed on heavy weight media and highly consistent image quality is required.

In the case of constant speed operation in conventional systems, a thermal load applied to the fuser roll has the characteristics of a step-function, and a fuser control system is not able to compensate the load in a timely manner.

Accordingly, there is an unmet need for systems and/or methods that facilitate overcoming the aforementioned deficiencies.

BRIEF DESCRIPTION

In accordance with various aspects described herein, systems and methods are described that facilitate controlling fuser speed to compensate for temperature droop as a function of job length and thermal load. For example, a method of reducing temperature droop due to thermal load during a print job comprises receiving job length information and media type information for a print job; accessing a lookup table and identifying a velocity profile, with an initial fuser speed for the print job, as a function of job length and media type, outputting the initial fuser speed to a fuser drive, and executing the print job. The method further includes monitoring fuser temperature during the print job; adjusting the velocity profile if the fuser temperature drops below a predetermined threshold temperature; and storing the adjusted velocity profile to the lookup table.

According to another aspect, a system that facilitates reducing temperature droop during fuser operation comprises a processor that receives job information for a print job and identifies a velocity profile with an initial fuser speed for a fuser drive during the print job, a memory that stores a lookup table that correlates media types and job lengths to initial fuser speeds, a temperature monitor that monitors fuser temperature during print jobs, and a velocity adjuster that adjusts the initial fuser speed and optionally fuser acceleration time for the print job as a function of fuser temperature measurement information during the print job.

According to another aspect, a printing platform comprises one or more xerographic components for executing a print job, a processor that receives job length and paper type information for a print job and identifies an initial fuser speed for the print job, and a memory that stores a lookup table that correlates paper types and job lengths to initial fuser speeds as a function of paper weight and thermal load, which is accessed by the processor to identify the initial fuser speed. The printing platform additionally comprises a temperature monitor that measures fuser temperature during print jobs, and a velocity adjuster that adjusts the initial fuser speed in a velocity profile for the print job as a function of fuser temperature measurement information during the print job.

DETAILED DESCRIPTION

In accordance with various features described herein, systems and methods are described that facilitate reducing "droop" that occurs during a temperature transient in a production printer fuser. For example, a temperature transient is a variation in fuser temperature between the time the fuser begins printing and the time at which fuser temperature reaches steady state. During this period, reduced fuser temperature causes less heat to be applied to the media (e.g., a page), causing a reduction in gloss, image quality, and/or or other undesirable effects. To mitigate the problem, fuser temperature can be increased to a level high enough to saturate gloss even during the transients. Alternatively, fuser speed can be reduced to minimize the transients by increasing exposure time of the media to the fuser.

Figure 1:
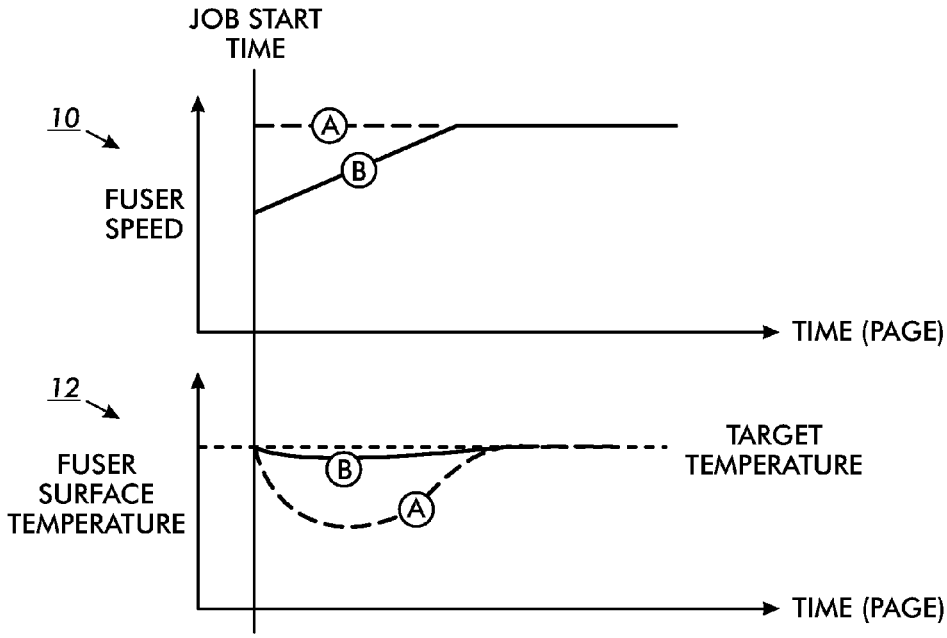
FIG. 1 illustrates a graph that shows a relationship between fuser speed and time in conjunction with a graph that illustrates a relationship between fuser surface temperature and time.

With reference to FIG. 1, a graph 10 that illustrates a relationship between fuser speed and time is shown in conjunction with a graph 12 that illustrates a relationship between fuser surface temperature and time. In graph 10, conventional fuser speed (A) is illustrated, and a corresponding temperature transient (A) that occurs in the fuser after job startup is shown in graph 12. To reduce the temperature transient, fuser speed is adjusted (B) such that it begins slower than a nominal or full fuser speed to avoid large temperature droop and gradually increases to its full capacity. Although the temperature increase from job start until the fuser reaches nominal temperature is depicted as a straight line or ramp, it will be appreciated that the temperature increase may have any desired slope or shape (e.g., curved, s-shaped, etc.), and is not limited to a linear function of time.

Since the print media or paper acts as a heat sink during the transient period, reducing fuser speed serves to keep the fuser on the paper longer, thereby applying a desired amount of heat to toner on the paper. As fuser temperature is increased, less time is required to deliver the same desired amount of heat. With variable speed operation such as is described herein, the thermal load increases gradually, allowing time for a control system to adjust for the thermal load, and thereby avoid temperature transients. In one embodiment, pitch timing is coordinated for xerographic operation along with the fuser speed.

Figure 2:
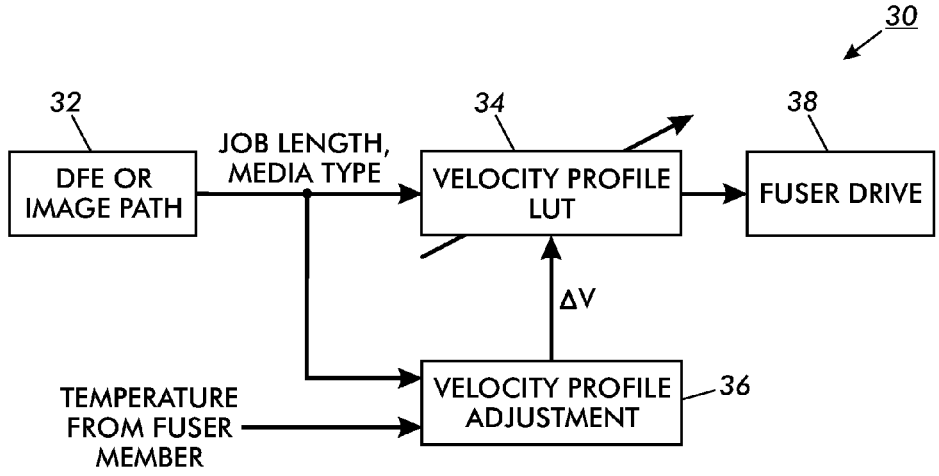
FIG. 2 illustrates a system for reducing temperature droop and the undesirable effects associated therewith, to maintain a desired level of image quality.

FIG. 2 illustrates a system 30 for reducing temperature droop and the undesirable effects associated therewith, to maintain a desired level of image quality. The system comprises a digital front end (DFE) 32, or image path, that feeds job information (e.g., job length, media type, etc.) to a velocity profile lookup table (LUT) 34 and a velocity profile adjustment (VPA) component 36. According to one example, job length is described as a number of pages to be printed, and media type information relates to paper type, thickness or weight, whether the paper is coated or uncoated, etc. The VPA component 36 also receives fuser temperature information from a fuser member (not shown) in a printer or copier device during each print job. If the temperature measurement for a given job is outside of a predetermined acceptable range of temperatures, the VPA component 36 outputs a velocity change to the LUT 34, which is stored in the velocity profile for the job (e.g., the job profile for the given media type and job length is updated as a function of fuser temperature information.

During printing, fuser speed is adjusted at a fuser drive 38 using the velocity profile contained in the LUT 34 for the current job. That is, fuser speed is adjusted according to the velocity profile in anticipation of a thermal load associated with the media type before it impacts the fuser. Since the speed changes are made ahead of time, other subsystems can be properly coordinated as well. Velocity profiles implemented in the LUT can be changed and/or updated as a function of detected fuser temperature, variations in environment, machine ages, and other disturbances to the system. In this manner, fuser temperature is measured in a current job run and fed forward to refine the velocity profile for the next run.

The LUT 34 includes a plurality of velocity profiles, which are cross-referenced to media type and job length. For instance, a first media type may have N profiles, each describing a velocity and/or acceleration pattern to be followed for different length jobs employing the first media type. For instance, a first profile can be for media type 1, job length of less than 3 pages. A second profile can be for media type 1, job length of 3-5 pages. A third profile can describe fuser acceleration for media type 1, job length 6-10 pages, and so on. A second media type has a plurality of velocity profiles cross-referenced to similarly graduated job lengths, etc. Thus, the LUT comprises velocity profiles for a plurality of media types, each media type having a plurality of profiles for different job lengths.

In one example, fuser temperature is measured during a print job using media type 1, with a job length of 4 pages. If the temperature measurement is below a predetermined threshold, then the VPA component 36 adjusts the velocity profile for media type 1, job length 4 pages, to reduce the initial fuser velocity and/or fuser acceleration rate, thereby reducing thermal load on the fuser during the temperature transient. The adjusted velocity profile is then stored in the LUT at the appropriate location in place of the original velocity profile, for use in subsequent jobs for the same media type and job length (or job length range). Velocity profiles for other media types and/or job lengths are left unaffected.

Figure 3:
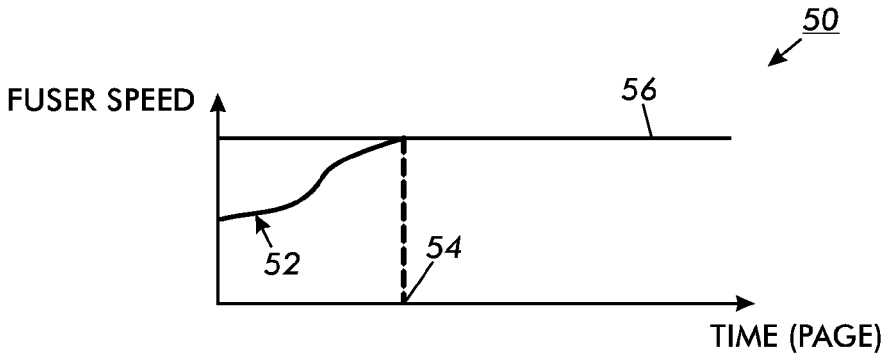
FIG. 3 illustrates a graph showing an example of parameterization such as is stored in the velocity profile LUT for speed profiles for each of a plurality of media types.

FIG. 3 illustrates a graph 50 showing an example of parameterization such as is stored in the velocity profile LUT 34 for speed profiles for each of a plurality of media types. In the graph 50, a relationship is shown between initial fuser speed 52, acceleration time 54 (e.g., the time at which the fuser reaches the nominal or "full" speed, and acceleration stops), and nominal fuser speed 56. The complexity of the parameterization may be varied to obtain an optimized speed profile. The nominal speed parameter 56 for heavy media (e.g., thicker pages, etc.) is usually smaller than that for light media. For a job as short as a page or two, initial fuser speed 52 may be set approximately equal to full speed 56. For a longer job (e.g., of 50 pages or more), initial fuser speed 52 may be set to approximately one half of full speed 56, for example. In another embodiment, acceleration time is adjustable to increase the period (or number of pages exposed to the fuser) between job initiation time ($t_0$) and the time when the fuser reaches steady state temperature ($t_{ss}$).

Figure 4:
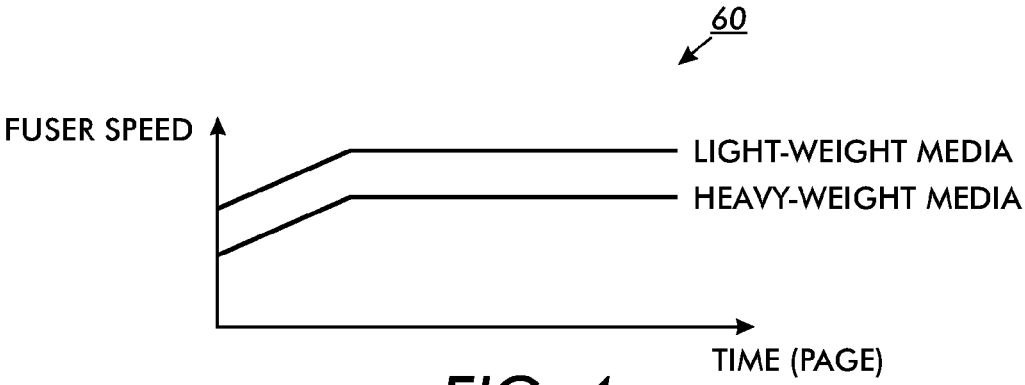
FIG. 4 illustrates a graph showing relationships between media types and fuser speed.

FIG. 4 illustrates a graph 60 showing relationships between media types and fuser speed. For instance, a light-weight media absorbs less heat (e.g., exhibits a relatively small thermal load) and therefore can have a higher initial fuser speed, since less fuser exposure is required to heat the media to a desired temperature. A heavier media has a larger thermal load, and therefore requires a slower initially fuser speed to ensure that sufficient heat is applied to the media.

Figure 5:
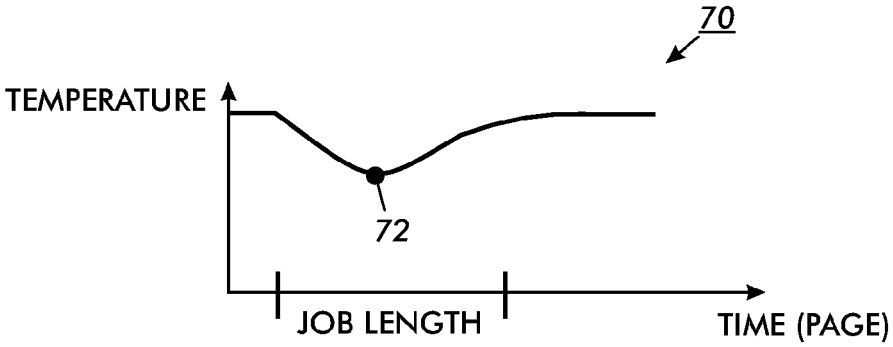
FIG. 5 illustrates graph of a temperature measurement from a job that is used to adjust a fuser speed profile for subsequent use in performing the job.

FIG. 5 illustrates graph 70 of a temperature measurement from a job that is used (e.g., by the VPA component 36) to adjust a velocity profile for the job. For example, a measurement of minimum temperature 72 during the print job can be analyzed, and if the measurement is smaller than a predetermined threshold value, initial fuser speed may be reduced and/or the time to reach nominal speed may be increased for the second job run. Nominal fuser speed need not be adjusted.

Figure 6:
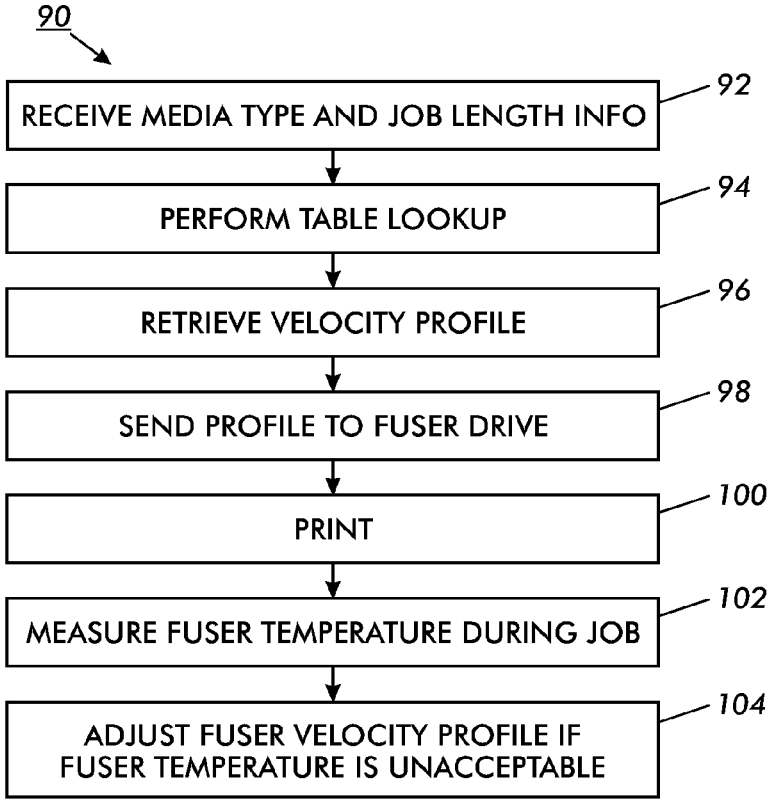
FIG. 6 illustrates a method related to mitigating undesirable temperature transients by varying fuser speed using temperature measurement information from a previous pint job for fuser speed control during a current print job, in accordance with various features.

FIG. 6 illustrates a method 90 related to mitigating undesirable temperature transients by varying fuser speed using temperature measurement information from a previous pint job for fuser speed control during a current print job, in accordance with various features. While the method is described as a series of acts, it will be understood that not all acts may be required to achieve the described goals and/or outcomes, and that some acts may, in accordance with certain aspects, be performed in an order different that the specific orders described.

The method 90 comprises receiving media type and job length information for a current job, at 92. For instance, the media can be paper of a given weight and type and the job length can be X pages, where X is an integer. At 94, a table lookup is performed for the given media and job length, to determine a starting fuser speed and acceleration time for a fuser performing the job. At 96, a fuser velocity profile is retrieved for the given media type and job length. At 98, the velocity profile is sent to the fuser drive for execution during the print job. The print job is performed at 100. At 102, fuser temperature is measured while the print job is in progress. If the fuser temperature is determined to be below a predetermined threshold value, the initial fuser temperature and/or acceleration time are adjusted in the velocity profile, at 104, and the updated profile is store for a subsequent job. According to an example, a print job may have a job length of 100 pages, and a media type comprising paper of an average weight. The media type and job length information can be analyzed and compared to a lookup table that includes job length and media type information as well as initial fuser speed and acceleration information. Initial fuser speed and fuser acceleration are then selected for the print job and output to a fuser drive, and the job is executed. Temperature measurements are made continuously or periodically during the job and are fed forward to a fuser drive adjustment component (e.g., a processor) or the like for use in adjusting fuser speed and/or acceleration in a subsequent job. If the temperature drops below a predetermined threshold value, then the fuser is experiencing too great a thermal load, and the initial velocity and/or acceleration are reduced in the velocity profile, which is stored to the lookup table for later user. In this manner, the next time the particular velocity profile is invoked (e.g., for a subsequent job using the same media type the same or approximately the same job length), the temperature minimum experienced by the fuser can be maintained above the predetermined threshold level.

To further this example, a next print job is then identified and job length and media type are analyzed in conjunction with the lookup table. For example, if the job has a job length of two pages, then the initial fuser speed may be set to full speed (and thus acceleration time is minimized), since the media does not have a substantial thermal sink effect for such a short job length. In one embodiment, the initial fuser speed is set to full speed for short job lengths (e.g., 1-5 pages or so) regardless of media weight.

In another example, the print job has a job length that is longer than the duration of a temperature transient to be avoided. That is, the job length is longer than the time required for the fuser to reach steady state temperature, and therefore it is desirable to adjust fuser speed to mitigate the negative effects of temperature droop between $t_0$ and $t_{ss}$. In this example, the media type and job length are compared to the lookup table to identify a velocity profile and determine an appropriate initial fuser speed and acceleration time for the fuser to employ during the job. Temperature measurement information collected during the job can be employed to adjust the initial fuser speed and/or the acceleration time for the identified profile if a temperature is detected below the predetermined threshold temperature. For instance, a minimum fuser temperature that occurred during the job during the temperature transient (e.g., when the thermal sink effect of the media was at its highest) can be compared to a predetermined threshold value, and if the temperature measurement is below the threshold value then the initial fuser speed in the profile can be further reduced. In this manner heat transfer from the fuser to the media can be maintained at a desired level, since heat transfer is a function of time and temperature. That is, by reducing fuser speed, heat application time is increased for each page to compensate for low fuser temperatures during the temperature droop between $t_0$ and $t_{ss}$.

Figure 7:
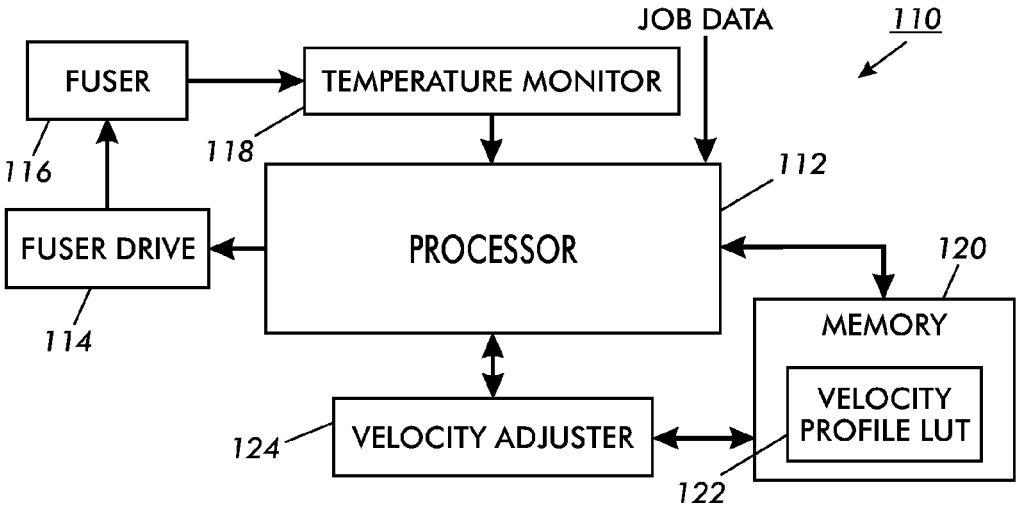
FIG. 7 illustrates a system for compensating for temperature droop in a fuser device during a print job, in accordance with various aspects described herein.

FIG. 7 illustrates a system 110 for compensating for temperature droop in a fuser device during a print job, in accordance with various aspects described herein. The system 110 comprises a processor 112 that executes one or more computer-executable algorithms for controlling a fuser drive 114 that drives a fuser element 116, such as may be employed in a xerographic device, a printer, a copier, or the like. A temperature monitor 118 provides fuser temperature measurement information from the fuser 116 to the processor 112. The processor also receives job data related to a print job or the like. In one example, job data includes media identification information and/or other attributes (e.g., media weight, size, coating, etc.) that can be used to identify or determine how much heat the media will absorb as it is exposed to the fuser 116. Job data also includes job length, such as a number of pages to be printed or the like.

The processor 112 accesses a memory 120 that stores the computer-executable algorithm(s) for controlling the fuser drive 114, as well as any other information and/or routine(s) suitable for carrying out the various functions described herein. The memory 120 additionally comprises a velocity profile lookup table 122, which is accessed by a velocity adjustor 124 and/or the processor 112 to perform a table lookup for the job data and temperature measurement data received. The velocity adjustor 124 and/or the processor 112 identifies a velocity profile that matches the job length and media type of the job, thereby identifying an initial fuser speed and/or acceleration time for the job to mitigate temperature droop and ensure that pages in the job receive a desired amount of heat. It will be appreciated that the velocity adjustor 124 may be a processor similar to processor 112 or may be integral to processor 112.

According to an example, the processor 112 receives job data including media type and job length information for a print job. The processor then accesses the lookup table 122 in the memory 120 and identifies an initial fuser speed and/or acceleration for the fuser drive 114 as a function of paper weight and/or other related media type parameters (e.g., paper composition, coating, etc.), and job length. In one embodiment, the lookup table 122 stores a thermal absorption value for each paper type that can be used in a device employing the system 110. The thermal absorption value is cross-referenced to an initial fuser speed and/or fuser acceleration that will compensate for the temperature droop caused by the paper as it absorbs heat from the fuser during a temperature transient. The processor 112 then outputs the identified initial fuser speed and/or acceleration time to the fuser drive 114 and the print job is executed.

The temperature monitor 118 provides temperature information to the processor 112 during the print job, and the temperature information is used to adjust fuser speed and/or acceleration in the velocity profile begin employed. For instance, the temperature monitor 118 can detect a lowest fuser temperature measurement during the print job, which occurs during the temperature transient caused by thermal absorption by the paper during an initial portion of the print job (e.g., between job initiation and the time when the fuser reaches a steady state temperature). The velocity adjustor 124 compares the temperature minimum from the print job to a predetermined threshold. If the temperature minimum is below the predetermined threshold, then the velocity adjuster 124 further reduces the initial fuser speed and/or acceleration identified in the velocity profile, and stores the updated velocity profile to the LUT for a subsequent job of similar length and media type. In this manner, factors (e.g., component wear or age, etc.) external to medial type and/or job length are compensated for using temperature information.

Adjusted velocity profiles generated as a function of historical fuser temperature data are stored to the memory 120 and/or the lookup table 122, in addition to or in place of original or template velocity profiles for various media types and weights. Once stored, the adjusted profiles become part of the database and may be accessed and further adjusted for future print jobs.

In another embodiment, fuser speed is adjusted along a curve that mirrors an anticipated temperature droop caused by a given media. For instance, since a temperature transient typically starts at or near steady state temperature, dips to a minimum, and then rises to steady state temperature, the fuser speed can be manipulated to start at or near nominal speed for a given print job, and can be reduced as temperature of the fuser decreases due to thermal load. At or about the temporal point where temperature reaches the minimum, fuser speed can be manipulated to increase to the nominal speed for the print job as fuser temperature increases to steady state. In this manner, fuser speed is adjusted to be slower when temperature is lower and faster when temperature is higher, thereby achieving a substantially constant thermal transfer to pages by causing the fuser to linger longer over a given page at lower temperatures.

According to other features, print quality can be augmented using a graduated skip pitch technique whereby blank pages are printed intermittently at various points in a page count for a job. For instance, in a 100 page print job, two of a first ten pages run past the fuser can be blanks, followed by one of a second ten pages, followed by one of a next 20 pages, and so on, so that skip pitch is gradually reduced as the fuser heats up. That is, a number of skipped pages is adjusted as a function of job length.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of reducing the effects of temperature droop due to thermal load during a print job, comprising:

receiving job length information and media type information for a print job;

accessing a lookup table and identifying a velocity profile, with an initial fuser speed for the print job, as a function of job length and media type;

outputting the initial fuser speed to a fuser drive;

executing the print job;

monitoring fuser temperature during the print job;

adjusting the velocity profile if the fuser temperature drops below a predetermined threshold temperature; and storing the adjusted velocity profile to the lookup table upon completion of the print job.

2. The method of claim 1, wherein the fuser drive starts at the initial fuser speed and accelerates up to a nominal speed for the print job.

3. The method of claim 1, wherein fuser temperature information comprises a temperature minimum detected during a temperature transient that occurs between fuser startup ($t_0$) and a time ($t_{ss}$) at which steady state temperature is achieved.

4. The method of claim 3, further comprising comparing the temperature minimum to the predetermined threshold value.

5. The method of claim 4, further comprising reducing the initial fuser speed in the velocity profile if the temperature minimum is less than the predetermined threshold value.

6. The method of claim 1, wherein the media type information comprises information related to at least one of paper type, paper weight, and thermal load information.

7. The method of claim 6, wherein the lookup table comprises initial fuser speeds that are inversely proportional to the thermal load of a given media type.

8. The method of claim 1, further comprising storing a plurality of velocity profiles in the lookup table, wherein each media type has a plurality of velocity profiles corresponding to different job length ranges.

9. The method of claim 2, wherein the fuser drive accelerates at a constant rate up to the nominal speed.

10. The method of claim 2, wherein the fuser drive accelerates at a variable rate up to the nominal speed.

11. A system that facilitates reducing the effects of temperature droop during fuser operation, comprising:

a processor that receives job information for a print job and identifies a velocity profile with an initial fuser speed for a fuser drive during the print job;

a memory that stores a lookup table that correlates media types and job lengths to initial fuser speeds;

a temperature monitor that monitors fuser temperature during print jobs; and a velocity adjuster that adjusts the initial fuser speed and optionally fuser acceleration time for the print job as a function of fuser temperature measurement information during the print job; wherein the processor stores the adjusted velocity profile to the lookup table in place of the initial velocity profile upon completion of the print job, for use in a subsequent print job.

12. The system of claim 11, wherein the job information comprises information relating to one or more of a number of pages in the job and paper type to be used in the job.

13. The system of claim 12, wherein the paper type information further comprises one or more of paper size, weight, and thermal load information.

14. The system of claim 13, wherein the velocity adjuster receives temperature information from the temperature monitor comprising a temperature minimum detected during a temperature transient between fuser startup ($t_0$) and a time ($t_{ss}$) at which steady state temperature is achieved during the print job.

15. The system of claim 14, wherein the velocity adjuster compares the temperature minimum to a predetermined threshold value.

16. The system of claim 15, wherein the velocity adjuster reduces the initial fuser speed in the velocity profile for the print job if the temperature minimum is less than the predetermined threshold value.

17. The system of claim 11, wherein the lookup table comprises a plurality of velocity profiles having initial fuser speeds that are inversely proportional to the thermal load of a given media type.

18. The system of claim 11, wherein the fuser drive accelerates at a constant rate up to a nominal speed for the print job.

19. The system of claim 11, wherein the fuser drive accelerates at a variable rate up to the nominal speed.

20. A printing platform, comprising:

one or more xerographic components for executing a print job;

a processor that receives job length and paper type information for a print job and identifies an initial fuser speed for the print job;

a memory that stores a lookup table that correlates paper types and job lengths to initial fuser speeds as a function of paper weight and thermal load, which is accessed by the processor to identify the initial fuser speed;

a temperature monitor that measures fuser temperature during print jobs; and a velocity adjuster that adjusts the initial fuser speed in an initial velocity profile for the print job as a function of fuser temperature measurement information during the print job;

wherein the processor stores the adjusted velocity profile to the lookup table in place of the initial velocity profile upon completion of the print job, for use in a subsequent print job.

* * * * *